United States Patent [19]

DiMarzio

[11] 4,227,434

[45] Oct. 14, 1980

[54] ADJUSTABLE SOUNDHOLE MOUNT FOR A MUSICAL PICKUP

[76] Inventor: Lawrence P. DiMarzio, 210 Davis Ave., Staten Island, N.Y. 10310

[21] Appl. No.: 879,206

[22] Filed: Feb. 21, 1978

[51] Int. Cl.[3] ..... G10H 3/00

[52] U.S. Cl. ..... 84/1.14; 84/1.15; 84/1.16

[58] Field of Search ..... 84/1.14, 1.15, 1.16, 84/DIG. 24

[56] References Cited

U.S. PATENT DOCUMENTS

| | | | |
|---|---|---|---|
| 2,784,631 | 3/1957 | Fender | 84/1.15 |
| 3,192,304 | 6/1965 | Rizzutti | 84/1.15 |
| 3,475,543 | 10/1969 | Burns | 84/1.15 |
| 3,780,202 | 12/1973 | Law | 84/1.14 |
| 3,869,952 | 3/1975 | Rowe | 84/1.16 |
| 3,911,777 | 10/1975 | Rendell | 84/1.16 |
| 4,142,435 | 3/1979 | Pozar | 84/1.16 |

*Primary Examiner*—J. V. Truhe
*Assistant Examiner*—Forester W. Isen
*Attorney, Agent, or Firm*—Auslander, Thomas & Morrison

[57] ABSTRACT

A simple adjustable mount is insertable in the soundhole of a stringed musical instrument where it supports itself without damage to the instrument. The mounted pickup is adjustable on the mount for desired position.

13 Claims, 4 Drawing Figures

FIG.1
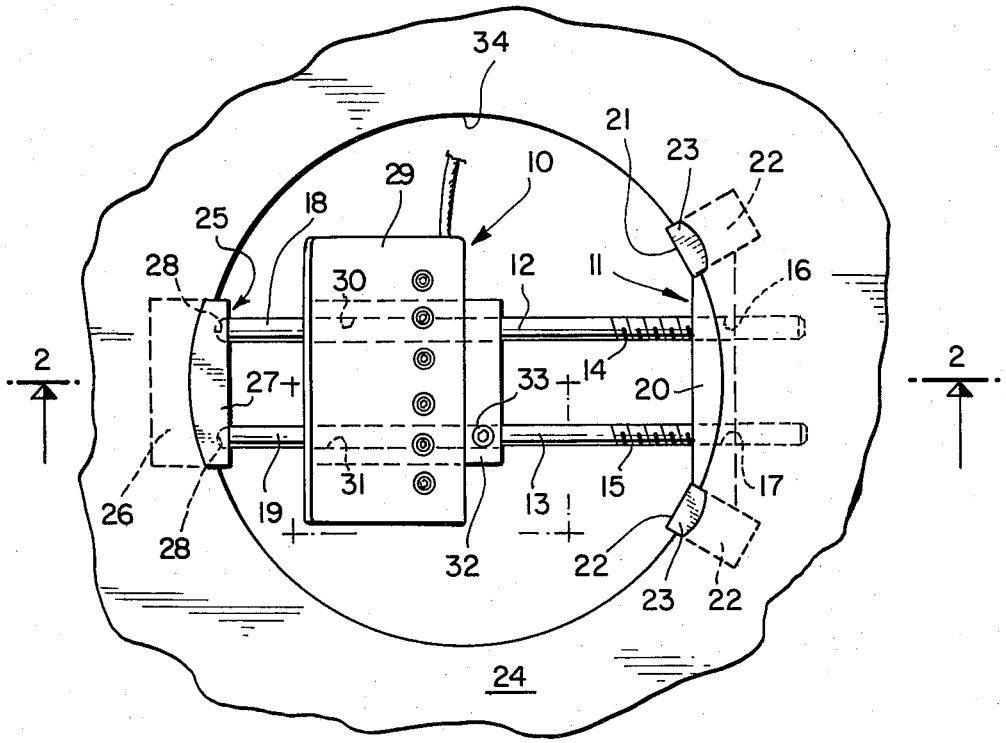
FIG.3
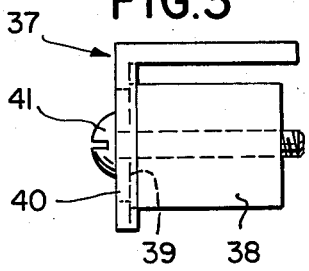
FIG.4
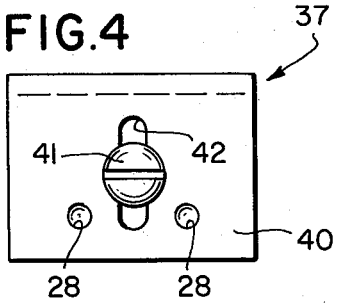
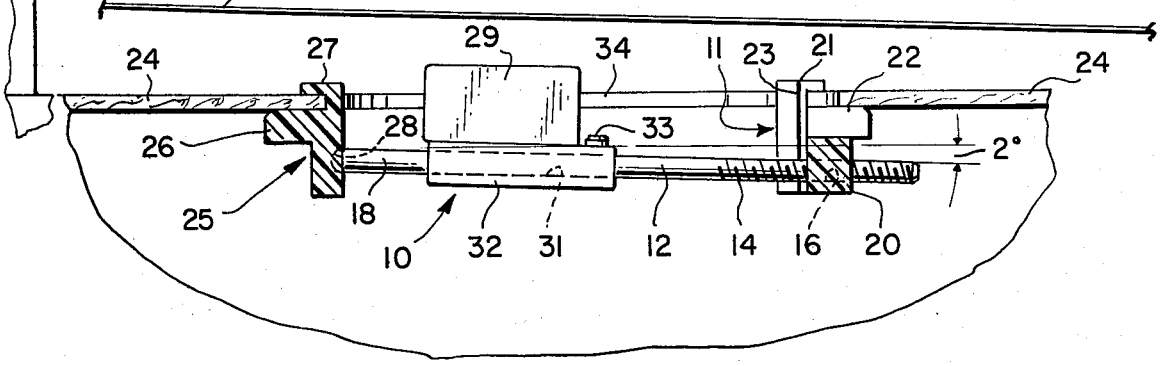
FIG.2

ADJUSTABLE SOUNDHOLE MOUNT FOR A MUSICAL PICKUP

The present invention relates to an adjustable soundhole mount for a musical instrument pickup.

In stringed musical instruments it is oftentimes desirable to have their sound picked up and amplified.

This invention is involved with a mount for a sound pickup to fit into the soundhole of a stringed musical instrument, such as a guitar, for instance, which also includes a sound box. The soundhole that the present invention is concerned with is generally a round soundhole beneath the strings as distinguished from "f shaped" soundholes which are also usable with acoustical stringed instruments.

The effect of the pickup is determined by its location on the instrument, particularly with regard to the harmonics of the strings. Pickups are usually permanently mounted on instruments. Where an instrument having a round soundhole does not have a permanently mounted pickup, the soundhole provides a good location for a removable pickup.

In the past, pickups have been clamped to the perimeter of the opening across the aperture having one or two point support such as in U.S. Pat. No. 2,261,358. Pickups also have been mounted employing various support means such as shown in U.S. Pat. No. 3,869,952. While the various mountings of the past have proven satisfactory, they have been awkward to adjust for the optimum positioning for selected tone quality. Of course pickups have been provided to be adjusted for such purpose as in U.S. Pat. No. 2,964,985, but easy adjustability has not been provided in a soundhole mount for a pickup.

According to the present invention, a soundhole mount for a pickup is provided, which is easily and effectively mounted in a musical instrument soundhole and further, is optionally adjustable once in place, for selected sound quality.

The soundhole mount is further easily adapted for mounting in different diameter and off round-shaped soundholes. The mount is firmly held in position without damaging the musical instrument nor detracting from the musical quality of the sound.

Although such novel feature or features believed to be characteristic of the invention are pointed out in the claims, the invention and the manner in which it may be carried out may be further understood by reference to the description following and the accompanying drawings.

FIG. 1 is a detail plan view of a soundhole and the pickup mount of the present invention.

FIG. 2 is a section of FIG. 1 on lines 2–2 further showing the position of the instrument strings.

FIG. 3 is a side elevation of an alternate mounting bracket of the present invention.

FIG. 4 is a rear elevation of FIG. 3.

Referring now to the figures in greater detail, where like reference numbers denote like parts in the various figures.

The soundhole mount 10 comprises a mount bracket 11 including a pair of rods 12, 13. The rods 12, 13 have threaded ends 14, 15 which engage in threaded openings 16, 17 in the bracket 11. The further extreme ends 18, 19 of the rods 12, 13 are preferably rounded.

The mount bracket 11 has a yoke portion 20 which includes the openings 16, 17. Extending from the yoke

20 are instrument body engaging means 21 having flat extending surfaces 22 and a transverse "L" shaped portion 23 spaced away from the flat surfaces 22, forming a gap adapted to receive the instrument body 24.

A second mounting bracket 25 has a flat extending surface 26 and an "L" shaped portion 27 spaced away from the flat extending surface 27 forming a gap adapted to receive the instrument body 24. The "L" shaped portions 23, 27 of the mounting bracket 11 and second mounting bracket 25 act as lips over slots formed between the flat extending surfaces 22, 26.

The second bracket 25 includes indentations 28 adapted to receive the ends 18, 19 of the rods 12, 13.

A pickup 29 is mounted on a block 32 in which are channels 30, 31, into which the rods 12, 13 fit. The block 32 extends beyond the bottom of the pickup 29 and has a screw 33 which may be adjusted to impinge on the rod 13. The screw 33 acts as a stop.

The pickup 29 may be mounted on the block 32 by conventional means such as by use of epoxy cement.

In use the mounting bracket 25 is usually engaged in the soundhole 34 aligned with the strings 35 engaged to the instrument body 24, preferably toward the bridge 36. The mounting bracket 11, with the pickup 29 mounted on the block 32 with the rods 12, 13 passing through, is then engaged with the body 24 aligned with the strings 35. It is preferable to loosen the strings 35 so the soundhole mount 10 will fit beneath them without difficulty. The screw 33 is preferably loose so that it does not engage the rod 13.

Once the soundhole mount 10 is within the soundhole 34, the rods 12, 13 are adjusted by extending to length by rotating the threads 14, 15 in the opening 16, 17 so that they extend with their ends 18, 19 engaged in the indendations 28. In this position the soundhole mount 10 is firmly engaged and braced with the parts mutually engaged.

The strings are then tightened and tuned. Once the strings are tuned, the pickup 29 is adjusted along the rods 12, 13 until the desired positioning for the tone the player desires is achieved. Then the screw 33 is tightened on the rod 15 and the pickup 29 is fully mounted and operative.

It should be noted that the rods 12, 13 are mounted on a downslope from the body 24 of about two degrees, so in adjusting the positioning of the pickup 29, it is parallel with the strings 35, which slope downward from the bridge to the tuning keys (not shown) to which the strings 35 are attached.

The mounting brackets 11, 25 are preferably of molded plastic such as styrene. They firmly grasp the perimeter of the soundhole 34 without damaging the body 24. Plastic is preferable because it has little effect on the sound characteristics of the instrument and the pickup 29. The rods 12, 13 are preferably metal, such as aluminum.

Mounting the pickup 29 by bonding it to block 32 with epoxy cement has proven satisfactory in terms of the stability of mounting and the noneffect of the mounting on the acoustics of the instrument and the quality of sound picked up.

The alternate second mounting bracket 37 as shown in FIGS. 3 and 4 is adjustable, having a flat extending surface in the form of a block 38 slidably mounted in a channel 39 in the "L" shaped portion 40. A screw 41 passes through the block 38. The "L" shaped portion 40 also has a slot 42 so that the block 38 may be adjusted such as to accommodate different thicknesses of the body 24. Once adjusted to the selected gap, the screw 41 is tightened to maintain the gap.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. An adjustable soundhole mount for a stringed musical instrument pickup comprising a first bracket, said first bracket including means to engage the perimeter of an instrument soundhole, a second bracket, said second bracket including means to engage the perimeter of said soundhole, pickup mount supporting means, said pickup mount supporting means comprising two parallel elements, said pickup mount supporting means extending from one of said brackets, said pickup mount supporting means include a length extending means, said pickup mount supporting means being parallel to the strings on said instrument on the same slope, means to engage said pickup mount supporting means with said other bracket, said first bracket and second bracket and pickup mount supporting means adapted to interact when mutually engaged to firmly support themselves within said soundhole, pickup mount means, said pickup mount means slidable on said pickup mount supporting means, and stop means, said stop means adapted to fix the position of said pickup mount means on said pickup mount supporting means along its length.

2. The invention of claim 1 wherein said pickup mount supporting means when extended to selected length braces said first bracket and said second bracket against said soundhole perimeter.

3. The invention of claim 1 wherein said first bracket's means to engage said soundhole perimeter include a pair of body engaging means, each said body engaging means having an "L" shaped portion and a spaced-away flat surface.

4. The invention of claim 1 wherein said first bracket includes a yoke.

5. The invention of claim 4 wherein said yoke includes at least one opening, said at least one opening including threads, said threads adapted to receive said pickup mount support means.

6. The invention of claim 1 wherein said pickup mount supporting means are a pair of rods.

7. The invention of claim 6 wherein said length extending means are threads.

8. The invention of claim 1 wherein said bracket's means to engage said soundhole perimeter include an "L" shaped portion and a spaced-away flat surface.

9. The invention of claim 1 wherein said second bracket includes indentations, said indentations adapted to engage said pickup mount supporting means.

10. The invention of claim 1 wherein said pickup mount means is a block, said block includes at least one channel.

11. The invention of claim 10 wherein said block includes a set screw adapted to impinge on said pickup mount supporting means.

12. The invention of claim 1 including a block wherein said pickup is mounted to said block by adhesive means.

13. The invention of claim 1 wherein said second bracket includes an "L" shaped portion, a slot in said "L" shaped portion, a block and screw means adapted to hold said block fixed in a selected position in said slot.

* * * * *